United States Patent [19]

Husmann

[11] Patent Number: 4,800,366

[45] Date of Patent: Jan. 24, 1989

[54] ALARM LOCATOR MODULE FOR PICKET BARRIER INTRUSION DETECTION AND LOCATION SYSTEM

[75] Inventor: Robert J. Husmann, Soquel, Calif.

[73] Assignee: Omni Signal, Inc., Capitola, Calif.

[21] Appl. No.: 82,029

[22] Filed: Aug. 4, 1987

[51] Int. Cl.[4] ..... G08B 25/00; G08B 13/00

[52] U.S. Cl. ..... 340/524; 340/550; 340/564; 340/590; 340/665

[58] Field of Search ..... 340/524, 540, 541, 550, 340/590, 564, 566, 596, 598, 665–668, 683; 256/8, 10, 34; 109/31, 38; 174/99 R, 113 R; 324/52, 66, 67; 379/25, 26

[56] References Cited

U.S. PATENT DOCUMENTS

| | | | |
|---|---|---|---|
| 4,197,529 | 4/1980 | Ramstedt et al. | 340/566 |
| 4,680,573 | 7/1987 | Ciordinik et al. | 340/550 |
| 4,703,313 | 10/1987 | Husmann et al. | 340/550 |

*Primary Examiner*—Donnie L. Crosland
*Attorney, Agent, or Firm*—Rosenblum, Parish & Bacigalupi

[57] ABSTRACT

An alarm locator module for use in association with a picket fence having a plurality of picket elements disposed along a tubular rail, each picket being armed with an intrusion detection device connected to a three line supervised conductive loop contained within said rail and in constant communication with the intrusion locator module. The intrusion locator module supplies voltage and current down a first line of the loop, having a plurality of resistive elements disposed in spaced apart relationship along a portion of its length. Current normally flows back up the loop via a return line to ground, unless an intrusion is detected, in which case the intrusion detection device causes a short between the first line and a second line of the loop thereby causing current to flow through the second line back to the intrusion locator device, which is capable of detecting and reporting the intrusion. Multiple intrusions cause an increase in current in the first line, which may be detected and measured to determine the distance between the first and last intrusions on the fence. An open circuit on any of the three lines halts the flow of current on the particular line affected and may also be detected. Location of a single short can be calculated by polling the voltage on the second line provided an open circuit has not also occurred.

11 Claims, 3 Drawing Sheets

ALARM LOCATOR MODULE FOR PICKET BARRIER INTRUSION DETECTION AND LOCATION SYSTEM

BACKGROUND OF THE INVENTION

1. Field of the Invention

The present invention relates generally to barrier and intrusion detection systems, and more particularly, to an alarm locator module for use with a picket barrier fence.

2. Discussion of the Prior Art

Existing technology in perimeter security systems typically includes the use of various types of fences in combination with barbed obstacles and various types of alarm systems. Such alarm systems have typically utilized some type of electronic sensor to augment the fence barrier and create an alarm if the perimeter is breached. In general, the more sophisticated perimeter systems currently in use combine an aggregate of the above devices, for example, e.g., fences, barbed obstacles and electronic sensors, in order to provide first, a notice of the attempted intrusion, and then a delay of the actual intrusion. Little technology exists which teaches combining such devices in what is considered to be an optimal manner, and few alarm systems are capable of determining exactly where the intrusion has occurred. The result achieved by prior art detection systems has been that the physical barrier is often diminished by the effectiveness of the sensors, while the sensors are often affected by the physical barrier. In addition, once the perimeter has been breached, most systems provide little or no support in the process of apprehending the intruder.

Prior art attempts to solve the problem are disclosed in U.S. Pat. Nos. 4,097,025 to Dettmann, et al; 4,155,083 to Slaats, et al; and 4,197,529 to Ramstedt, et al. Dettmann disclose vibration sensors connected to a fence which detects vibrations of the fence occurring during an intrusion attempt and generates signals for input to the alarm system. Slaats disclose a fence made of wire elements comprised of coaxially conductive layers separated by a thin insulated layer. Intruder pressure applied to the fence generates a contact resistance between the conductive layers or a change in the capacitance between the layers that results in a measureable event, which upon detection, causes an alarm system to be actuated.

A timed domain reflectometer is utilized by Ramstedt et al. in combination with an external conductive sheath and an internal conductor separated by a layer of insulating material, such that any deformation of the sheath relative to the central conductor generates a variation in the impedance of the cable which can then be detected and used to actuate an alarm.

Each of the above prior art approaches are subject to the disadvantages of: requiring an aesthetically unpleasing fence structure; providing an apparatus which can be easily violated by a knowledgeable intruder; having a high susceptibility to false alarms caused by non-intruders; and often being ineffective in determining the point of intrusion.

SUMMARY OF THE PRESENT INVENTION

It is therefore an object of the present invention to provide a novel intrusion detection and location system which is both aesthetically pleasing and capable of accurately detecting intrusions versus non-intrusions.

Another object of the present invention is to provide an alarm locator module which is communicatively coupled to a supervised detection loop run along at least a portion of the length of the fence.

Still another object of the present invention is to provide an alarm locator module which is capable of detecting a single intrusion and calculating the location of that intrusion.

A further object of the present invention is to provide an alarm locator module which is capable of detecting multiple intrusions and calculating the distance between the intrusion occuring closest to the intrusion locator module and the intrusion occurring furthest from the intrusion locator module.

A still further object of the present invention is to provide an alarm locator module having the ability to detect an open circuit in any part of the supervised detection loop while still being capable of detecting any intrusion occurring between the open circuit and intrusion locator module.

A still further object of the present invention is to provide an alarm locator module which provides voltage and current across the contact points of a switch located at the point of intrusion along the fence instantaneously at the time of switch closure to insure the making of the contact by the switch, despite build up of insulative layers which accumulated upon the contact points over time.

Briefly, a preferred embodiment comprises an alarm locator module used in association with a picket fence having a plurality of picket elements disposed along a tubular rail, each picket being armed with an intrusion detection device connected to a three line supervised conductive loop contained within said rail and in constant communication with the intrusion locator module. The intrusion locator module supplies voltage and current down a first line of the loop, having a plurality of resistive elements disposed in spaced apart relationship along a portion of its length. Current normally flows back up the loop via a return line to ground, unless an intrusion is detected, in which case the intrusion detection device causes a short between the first line and a second line of the loop thereby causing current to flow through the second line back to the intrusion locator device, which is capable of detecting and reporting the intrusion. Multiple intrusions cause an increase in current in the first line, which may be detected and measured to determine the distance between the first and last intrusions on the fence. An open circuit on any of the three lines halts the flow of current on the particular line affected and may also be detected. Location of a single short can be calculated by polling the voltage on the second line, provided an open circuit has not also occurred.

These and other objects of the present invention will no doubt become apparent to those skilled in the art after having read the following detailed disclosure of a preferred embodiment which is illustrated in the several figures of the drawing.

IN THE DRAWING

DETAILED DESCRIPTION OF THE PREFERRED EMBODIMENT

Figure 1:
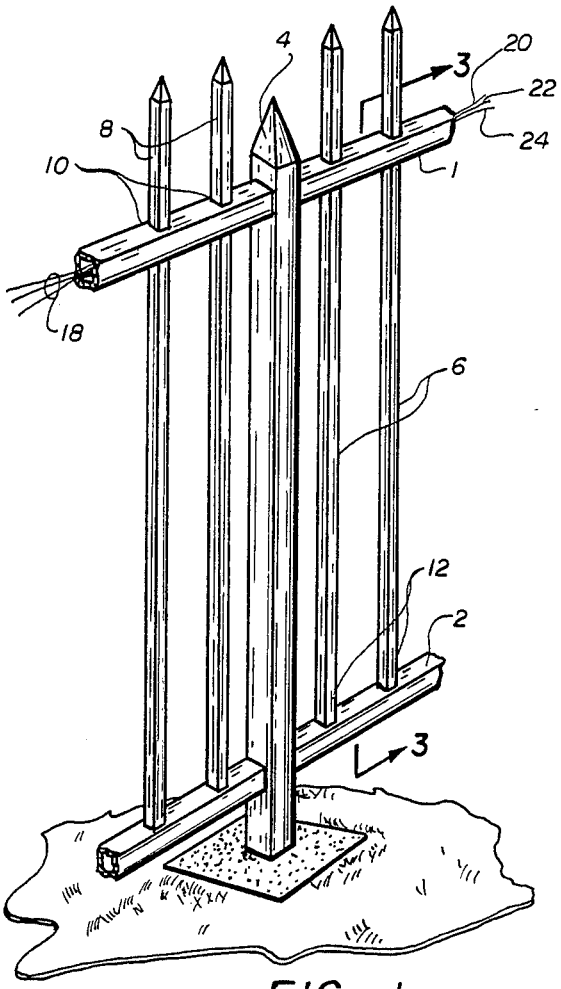
FIG. 1 illustrates a fence configuration which may be used in accordance with a preferred embodiment of the present invention.

Referring now to FIG. 1 of the drawing, a picket fence and alarm locator module in accordance with the present invention is shown generally, which includes a pair of horizontally extending upper and lower rails 1 and 2, the ends of which are attached to post 4. A plurality of vertically movable pickets 6, each of which is generally rectangular in cross-section, but which alternatively may be orthogonal, circular or oval, etc., in cross-section, are disposed in parallel spaced relationship between the two rails. Likewise, both upper and lower rails 1 and 2 may be generally rectangular in cross-section or varied in configuration similarly to pickets 6. Although pickets 6 are shown suspended above ground by bottom rail 2, it is to be understood that alternatively, various ones of the pickets can be extended into the ground, therefore removing the need for post 4.

Picket extensions or finials 8 extend through a hole 10 in the top side of rail 1 and are attached to a support means on the inside of the rail by welding or some other suitable means of affixing the finials. Ideally, the finials should be attached such that they cannot be pulled off or otherwise separated from the top rail of the fence, yet have the ability to give somewhat so that an intrusion can be detected due to pulling or pushing upon the finials. Likewise, pickets 6 are shown extending through a hole 12 in bottom rail 2 and would be similarly affixed inside bottom rail 2 as are finials 8.

Upper and lower rails 1 and 2 follow the line 3—3, thereby extending the length of the fence in those directions. Contained within upper rail 1 is a detection means (not shown) capable of detecting certain amounts of force applied to either pickets 6 or finials 8, and thereby communicating the detecting force to an intrusion locator module (not shown) by means of a supervised conductive loop, shown generally at 18 extending through the upper rail 1. The supervised conductive loop 18 is comprised of the resistive line 20, a sense line 22 and a return line 24, each of which is communicatively coupled to the intrusion locator module at a remote location, which will be shown more fully below.

Figure 2:
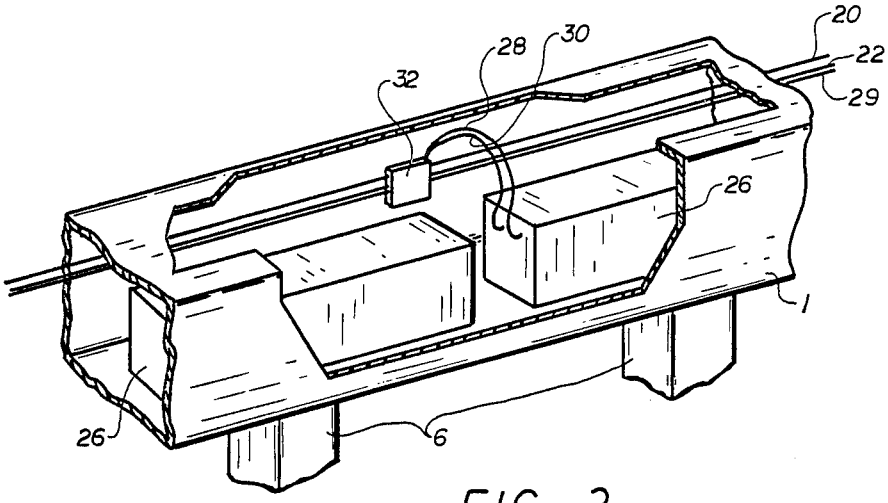
FIG. 2 is a broken partial cross-section taken along the line 3—3 of FIG. 1, illustrating intrusion detection components located above two pickets in the upper rail.

In FIG. 2, there is shown a broken, partial cross-section of the inside of upper rail 1, depicting the intrusion detectors 26 located above each picket 6. Finials 8 are not shown because the upper portion of rail 1 has been removed, however finials 8 would likewise extend into intrusion detectors 26 as do pickets 6 and thereby allow for detection of finial movement. A picket or finial is generally considered to be intruded when one of either is moved by a certain amount of force, such as 75 pounds, which would distinguish intrusion movement from small animals, birds or children disturbing the fence. Detection of the greater force results in a single being sent along communication lines 28 and 30 to switch 32. The closure of switch 32 in response to the intrusion detection signal causes a short to occur between resistive line 20 and sense line 22, which can thereby be detected by the intrusion locator module.

Figure 3:
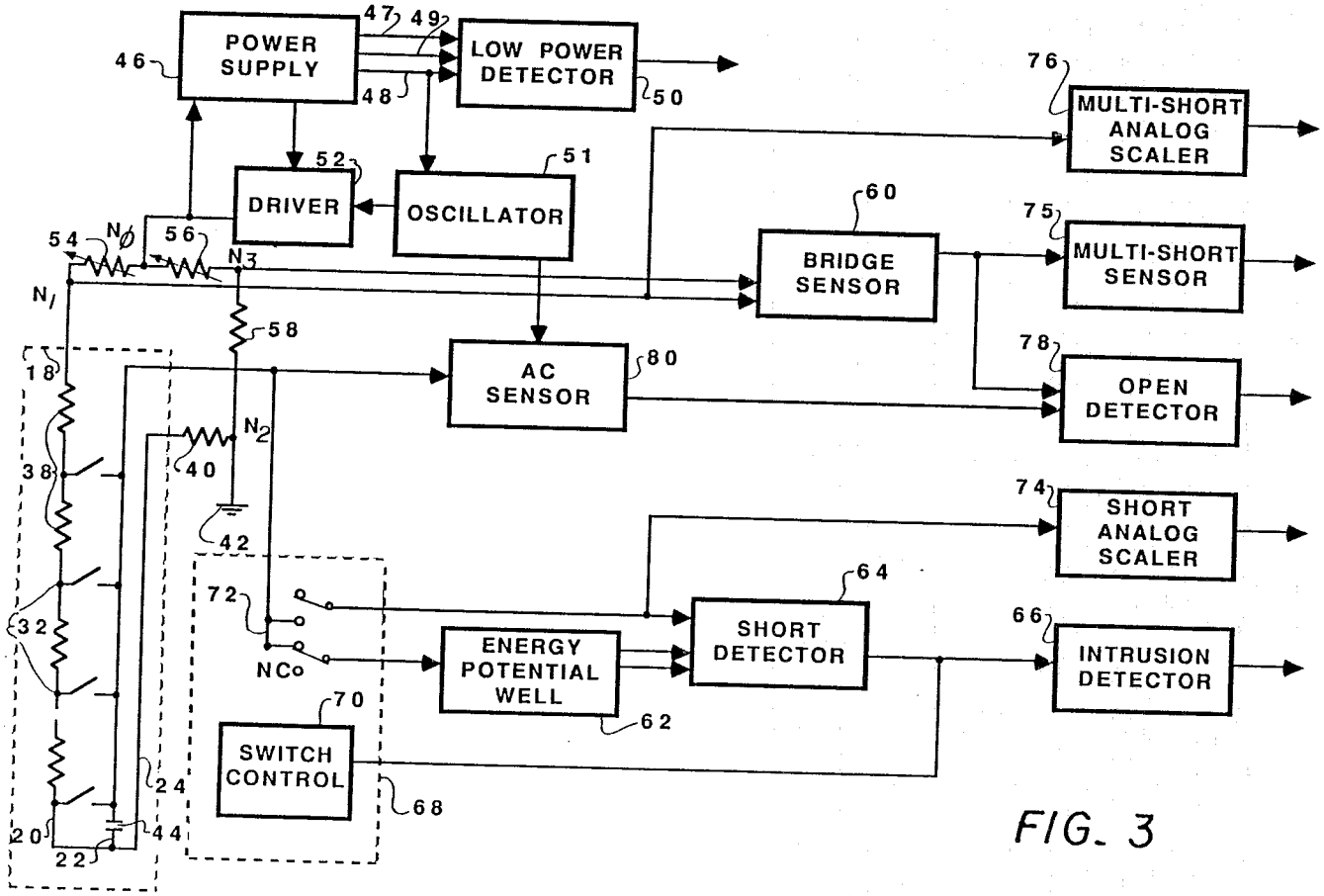
FIG. 3 is a diagram schematically illustrating an alarm locator module monitoring circuit in accordance with a preferred embodiment of the present invention.

Turning now to FIG. 3 of the drawing, a schematic diagram is provided illustrating an intrusion locator module in accordance with the present invention. Supervised conductive loop 18 is shown comprised of resistive line 20, sense line 22 and return line 24. Resistive line 20 is connected to one side of switches 32, approximately located in line with each fence picket and finial. Resistors 38 are spaced along the length of the fence with one resistor per resistive section of fence, where one resistive section of fence may be as small as a few inches or as large as a number of yards. The shorter the length of each resistive section, the greater the number of resistors located on resistive line 20. Thus, if a resistive section is approximately 20 feet in length, as many as 2500 resistive sections may be monitored by a single intrusion locator module.

Resistive line 20 is shown broken to indicate that the line extends for a longer length than is shown by FIG. 3. Return line 24 is connected to the end of resistive line 20 and extends back along the fence to resistor 40 and ground 42, thereby allowing for a voltage potential to be established across the length of the fence when voltage is applied to resistive line 20. Sense line 22 connects to the opposite side of switches 32 and is capacitively coupled to the end of the resistive line 20 and return line 24 by capacitor 44. It is to be noted that although resistor 40 is not actually located on resistive line 20, its resistance value is added to the total resistance value of resistors 38 when calculating the total resistance along resistive line 20.

A power supply 46 provides a stable filtered 5-volt DC reference voltage 47, a stable filtered 10-volt DC reference voltage 48 and a stable, but unfiltered, 10-volt DC voltage 49, each of which may be variously used as input voltages throughout the system. Voltages lines 47, 48 and 49 are constantly monitored for the occurrance of a low voltage condition by low-power detector 50, which will produce a logic level output indicating the occurrance of a low power condition on any of the three voltage lines.

Filtered reference voltage 48 is supplied to oscillator 51, which thereby creates a zero-to-ten volt peak square wave with a 50% duty cycle, operating at apporoximately 10 kilohertz frequency, that is output to line driver 52. Driver 52 is also fed with the unfiltered voltage 49 in order to supply current necessary to drive the 10 kilohertz AC square wave down to the resistive line 20. The output of driver 52 is routed back to power supply 46, where a voltage doubler is utilized to create a negative 10-volt to positive 10-volt square wave, thereby providing a negative 10-volt reference voltage which may be used in other portions of the system.

Before the 0-to-10 volt square wave reaches the resistive line 20, the signal is branched at Node 0 (N0) allowing the signal to pass through resistor 54 to Node 1 (N1) and through resistor 56 to Node 3 (N3). Signals passing through N3 would in turn normally also pass through resistor 58 to Node 2 (N2), otherwise referred to as ground 42. As will be noted, resistors 54, 56 and 58 form three legs of a resistive bridge, with resistive line 20, including all of resistors 38 and resistor 40, forming the fourth leg of the resistive bridge.

Once known, resistance values are established for all four legs of the resistive bridge, any change in resistance along any of the legs of the bridge can be monitored by comparing the voltage or current differences detected at Node 1 and Node 3. It should be noted that depending upon the length of the fence, and thereby the length of the resistive line 20, each individual resistor 38 must be of a relatively small amount of resistance, such as 10 ohms, so that the overall resistance value of the resistance leg formed by resistive line 20, is not too great. In addition, if resistors 54 and 56 are variable resistors, variable lengths of fence and therefore various amounts of resistance in resistive line 20 may be compensated for by simply adjusting the amount of resistance in resistors 54 and 56.

At Node 1 and Node 3, the 10 kilohertz AC signal is a 0-to-5 volt square wave with a 50% duty cycle, due to resistors 54 and 56 acting as voltage dividers. Although the signal, which is the same at both Node 1 and Node 3, is an AC signal, the square wave shape of the signal and the 50% duty cycle assure that an average DC voltage of half of the peak value of the signal is also provided on those lines. Thus, if the peak value of the AC signal is 5-volts, the average DC voltage at Node 1 and Node 3 will be 2.5-volts. The voltage and current detected at Nodes 1 and 3 are input to bridge sensor 60, which acts to detect any current imbalance at either of the Nodes.

If an intrusion was to occur, thereby closing any of switches 32, a path would be created between resistive line 20 through the particular closed switch to sense line 22. Sense line 22, during operation, is normally held to a negative 10-volts DC by the energy potential well 62, provided that all of the switches 32 are open. Thus, when one of switches 32 is closed, an instaneous voltage and current is passed across and through the switch upon its closure. The fence is designed to be operable for a great number of years. During the projected period of useage, many of the switches will never be activated, thereby allowing for insulative layers to build up upon switch contact surfaces and possibly restricting the actual closure of a switch during an intrusion. By providing for a potential energy at each switch upon closure, the insulative layers may be broken through, therefore assuring a switch "make" upon switch closure.

A switch closure caused by an intrusion of the fence causes an in-rush of current to pass through the switch and charge the energy potential well 62. As the voltage rises with time within the energy potential well 62, it is measured by short detector 64 until a particular voltage level has been reached. A time constant of the energy potential well 62 allows for an appropriate switch closure de-bounce of a switch 32 to insure the detection of an intrusion attempt, as opposed to the detection of a false alarm.

Once the appropriate voltage level of an intrusion has been reached, short detector 64 outputs an intrusion signal to both intrusion detector 66 and relay circuit 68, having a switch control 70 for receiving the intrusion signal from short detector 64. Intrusion detector 66 senses the intrusion signal received from short detector 64 and produces a logic level output to indicate an intrusion. Upon receiving the intrusion signal from short detector 64, switch control 70 switches switch 72 from its normal operating position, as shown in FIG. 3, to its intrusion detection position, whereby short detector 64 is connected to the sense line 22 and energy potential well 62 is disconnected from the sense line 22, thereby allowing the energy potential well 62 to discharge.

By switching the input of short detector 64 to the sense line 22 with switch 72, the voltage present on the sense line 22 is input to short analog scaler 74, which scales the voltage on the sense line 22 due to a switch closure on the fence and provides a 0-to-5 volt analog output which is linearly proportional to the position of the switch closure on the fence.

Because only a single switch closure occurring during an intrusion attempt would be highly unlikely, the intrusion locator module must not only be able to detect and locate the position of a single switch closure, but must be also be able to indicate a multiple amount of switch closures and the approximate location of all additional switch closures. Although a single switch closure would not affect the resistance value of resistive line 20, because current would continue to flow through all of sense line 22 and resistive line 24, multiple switch closures would create multiple current paths and loops and change the resistance value of resistive line 20. When a change in the amount of current flowing through Node 1 and Node 3 is detected by bridge sensor 60, a multiple short condition is reported to multi-short sensor 75, which produces a logic level output indicating multiple intrusions.

For each change in the resistance in resistive line 20, there is a proportional change in the current through Node 1 which in turn can be detected by bridge sensor 60. In addition to being input to bridge sensor 60, current flowing through Node 1 is also input to multi-short analog scaler 76, which like short analog scaler 74, measures the increase in current and provides a 0-to-5 volt analog output which is proportional to the distance between the first short on resistive line 20 and a last short on resistive line 20. This value, representing the physical distance between a first short and a last short, may then be used in combination with the value output by short analog scaler 74, to determine the approximate location of the first and last intrusions.

Many intrusion attempts would also be likely to include a direct attack on the integrity of the fence, as well as an attempt to either scale or go through the fence. Thus, it is necessary for the intrusion locator module to be able to detect an open circuit occurring on any of the three lines of the supervised loop 18. An open circuit on either resistive line 20 or return line 24 results in an incomplete flow path for current normally flowing through Node 1 to ground 42. The absense of current passing through Node 1 would be detected by bridge sensor 60 and result in an open circuit output signal being issued to open detector 78. Open detector 78 would, in turn, produce a logic level output indicating that an open circuit has been detected.

An open circuit occurring on sense line 22 can also be detected. The AC signal driven down the resistive line 20 is not inhibited by capacitor 44 and therefore can return back up the fence via both the return line 24 and the sense line 22. The presence of the AC signal on the sense line allows for the supervision of the sense line 22 during operation, and the detection of an open circuit occurring on the sense line 22, due to either an intrusion or some other event. Upon the occurence of an open circuit on sense line 22, AC sensor 80 outputs a signal to open detector 78, which produces a logic level output indicating that an open has been detected on the sense line 22.

AC sensor 80 also receives an AC square wave signal that is equivalent to the square wave signal input to driver 52. A comparison can therefore be made between the equivalent input signal and the signal received over the sense line by AC sensor 80. Synchronous comparison of the two signals allows for any intermittances occurring on the resistive line 20 or sense line 22, or changes in frequency on either of those two lines, to be detected by AC sensor 80 and indicated as an open by open detector 78.

As stated above, an intrusion may often be combined with a physical attack on the fence causing an open on one or more of the three lines. Although the occurrance of an open circuit can be detected, the position of an open circuit cannot be determined automatically by the intrusion locator module and, in addition, an open circuit of any of three lines makes it impossible to locate the position of a switch closure. However, any switch closure that does occur upstream of an open circuit on either the resistive line 20 or sense line 22 may still be detected by the intrusion locator module. Whereas an open on the resistive line 20 or return line 24 normally results in an incomplete flow path and no current flow through Node 1, a switch closure occurring upstream of the open allows for a flow path through the closed switch 32 to AC sensor 80 and energy potential well 62, thereby allowing current to pass through Node 1.

Although switch closures occurring upstream of an open circuit may be detected, it should be noted that because of the open circuit on the line, any measurements made by short analog scaler 74 or multi-short analog scaler 76 after the switch closures would be inaccurate. Therefore, when an open circuit has occurred, the switch closure location (intrusion) calculated by either short analog scaler 74 or multi-short analog scaler 76 cannot actually be used to determine the location of either the open circuit or the intrusion. Likewise, it is to be understood that any intrusion occurring downstream of an open cannot possibly be detected because no current flows through the necessary lines at the point of intrusion. Naturally, an open circuit on return line 24 would not inhibit the detection of a switch closure at any point along resisitive line 20.

A light or similar alarm may be located at each switch 32, thereby allowing for the manual location of a switch closure occurring on the fence despite of open also occurring downstream. Depending upon which or how many of the three lines have been cut, an open circuit upstream of the switch closure may even present the light or alarm from being powered and from being useful. The logic level outputs of low power detector 48, intrusion detector 66, multi-short sensor 75 and open detector 78 may also be used to operate a light, a bell, or some other type of alarm or warning device. In addition, the sensor and detector outputs, provided an open circuit has not also been detected, in combination with the outputs from short analog scaler 74 and multi-short analog scaler 76, may also be input to a controller device capable of evaluating each output and automatically determining the exact location of any intrusion.

Although the present invention has been described above in terms of a preferred embodiment, it is contemplated that numerous alterations and modifications of the invention will be apparent to those skilled in the art after having read the above disclosure. It is therefore intended that the following claims be intrepreted as covering all such alterations and modifications as fall within the true spirit and scope of the invention.

I claim:

1. An alarm locator module for use in association with a picket fence barrier having a first, second and third continuous conductor extending through a horizontal rail forming a part of the picket fence, having means for causing an open circuit in one of the conductors in the event that one of the conductors is severed and means including sensors associated with one or more of the pickets and adapted to cause a short across said first and second conductors in the event that a picket is deformed more than a predetermined amount, comprising:

signal supply means for communicating a first signal down a first end of said first conductor means;

connection detection and location means for determining when a first short has occurred across said first and second conductors and for determining the location of said first short; and open circuit detection means for determining when an open circuit occurs on one of said conductors.

2. An alarm locator module for use in association with a picket fence barrier as recited in claim 1 wherein said signal supply means comprises:

power supply means for supplying appropriately valued power signals to said connection detection and location means, said open circuit detection means, and throughout a remainder of said signal supply means;

oscillation means for receiving a first positive power signal from said power supply means and vacillating said first power signal; and driver means for receiving said vacillated power signal, creating said first signal, and driving said first signal through an output of said driver means which is communicatively coupled to said first conductor.

3. An alarm locator module for use in association with a picket fence barrier as recited in claim 2, wherein said power supply means includes means for receiving said first signal and creating a first negative power signal therefrom.

4. An alarm locator module for use in association with a picket fence barrier as recited in claim 3, wherein said first conductor has a plurality of electrical resistive elements disposed in spaced apart relationship along a portion of the length of said first conductor, a first end of said second conductor is capacitively coupled to a first end of said first conductor, a first end of said third conductor is coupled to said first end of said first conductor to form a commonly coupled end, and wherein said connection detection and location means comprises:

single connection detection and location means for determining when said first short has occurred along said first and second conductors and determining the location of said first short along said first and second conductors; and multiple connection detection and location means for determining when said first short has occurred and is followed by a second short occurring in time either before or after said first short along said first and second conductors and determining the distance from said first short to said second short along said first and second conductors.

5. An alarm locator module for use in association with a picket fence barrier as recited in claim 4, wherein said single connection detection and location means comprises:

a switching means connected on one end to the other end of said second conductor;

an energy well means normally connected to said other end of said second condutor through said switching means for inducing said first signal to pass from said first conductor to said second conductor when a short occurs and causing said first signal to flow to said energy well means until a first voltage level has been reached;

short detector means for measuring the voltage level in said energy well means, determining when said first voltage level has been reached and issuing a first control signal which causes said switching means to switch the connection between said other end of said second conductor and said energy well means to a connection between said short detector means and said other end of said second signal;

intrusion detection means for receiving said first control signal and indicating the occurrence of said short; and connection location means for receiving said first signal and deriving a second voltage value that is proportional to the location of said short between said first and second conductors.

6. An alarm locator module for use in association with a picket fence barrier as recited in claim 5, wherein said energy well means is created by said first negative power signal.

7. An alarm locator module for use in association with a picket fence barrier as recited in claim 4, wherein said multiple connection detection and location means comprises:

charge fluctuation detection means for monitoring said first conductor, detecting a variation in the amount of electrical charge carried by said first signal, and issuing a charge fluctuation signal;

multiple connection sensor means for receiving said charge fluctuation signal and reporting the occurrence of said second shorts; and multiple connection location means for monitoring said first signal, detecting a variation in the amount of electrical charge carried by said first signal, and determining the distance from said first short to said second short along said first and second conductors.

8. An alarm locator module for use in association with a picket fence barrier as recited in claim 4, wherein said multiple connection detection means comprises:

charge fluctuation detection means for monitoring said first conductors, detecting a cessation in the amount of electrical charge carried by said first signal, and issuing a charge cessation signal; and open circuit indicator means for receiving said charge cessation signal and reporting the occurrence of an open circuit on either said first or third conductors.

9. An alarm locator module for use in association with a picket fence barrier as recited in claim 4, wherein a first end of said third conductor is coupled to the other end of said first conductor, and wherein said open detection means includes:

charge cessation detection means for monitoring said first and third conductors, detecting the cessation of electrical charge carried by said first signal as said first signal flows along said first and third conductors, and issuing a first cessation detection signal upon the detection of charge cessation in either conductor; and open circuit indicator means for receiving said first cessation detection signal and reporting the occurrence of an open circuit on either said first or third conductors.

10. An alarm locator module for use in association with a picket fence barrier as recited in claim 9, wherein said open circuit detection means further includes synchronization detection means for receiving said vacillated power signal from said oscillation means, comparing said vacillated power signal to said first signal for determining any variation in the synchronization of said first signal, and issuing a second cessation detection signal to said open circuit indicator means, whereby said open circuit indicator means receives said second cessation detection signal and reports the occurrence of an open circuit on either said first or second conductors.

11. An alarm locator module for use in association with a picket fence barrier as recited in claim 2, wherein said signal supply means further includes a low-power detection means for determining when any of said power signal fall below the appropriate value for said power signals.

* * * * *